US006032468A

United States Patent [19]

Fetescu et al.

[11] Patent Number: 6,032,468

[45] Date of Patent: Mar. 7, 2000

[54] METHOD AND DEVICE FOR GENERATING STEAM

[75] Inventors: Mircea Fetescu, Ennetbaden, Switzerland; Werner Kessel, Gailingen, Germany

[73] Assignee: Asea Brown Boveri AG, Baden, Switzerland

[21] Appl. No.: 09/079,180

[22] Filed: May 15, 1998

[30] Foreign Application Priority Data

May 17, 1997 [DE] Germany ..... 197 20 789

[51] Int. Cl.[7] ..... F01K 7/34; F01K 13/00

[52] U.S. Cl. ..... 60/653; 60/676; 60/677; 60/679

[58] Field of Search ..... 60/653, 676, 670, 60/677, 679

[56] References Cited

U.S. PATENT DOCUMENTS

| | | | |
|---|---|---|---|
| 2,830,440 | 4/1958 | Durham | 60/653 |
| 2,867,983 | 1/1959 | Armacost | 60/653 |
| 4,887,431 | 12/1989 | Peet | 60/653 X |
| 5,375,410 | 12/1994 | Briesch et al. . | |
| 5,442,919 | 8/1995 | Wilhelm | 60/653 X |

FOREIGN PATENT DOCUMENTS

| | | |
|---|---|---|
| 4434526C1 | 4/1996 | Germany . |
| 19542917A1 | 6/1996 | Germany . |
| 149548806A1 | 8/1996 | Germany . |

*Primary Examiner*—Hoang Nguyen
*Attorney, Agent, or Firm*—Burns, Doane, Swecker & Mathis, L.L.P.

[57] ABSTRACT

A conventional steam power plant or a combined power plant is provided with intermediate superheating. At least part of the superheated steam in the superheater (3) and the intermediately superheated steam in the intermediate superheater (9) are subject to an indirect heat exchange. The device is characterized in that the superheater (3) and the intermediate superheater (9) are provided with at least one mutual superheater/intermediate superheater heat exchanger unit (19). The unit (19) includes, for example, a double-walled pipe (21) whose inner pipe is provided for the superheater steam flow, and whose outer pipe is provided for the intermediate superheater steam.

8 Claims, 6 Drawing Sheets

FIG. 5A
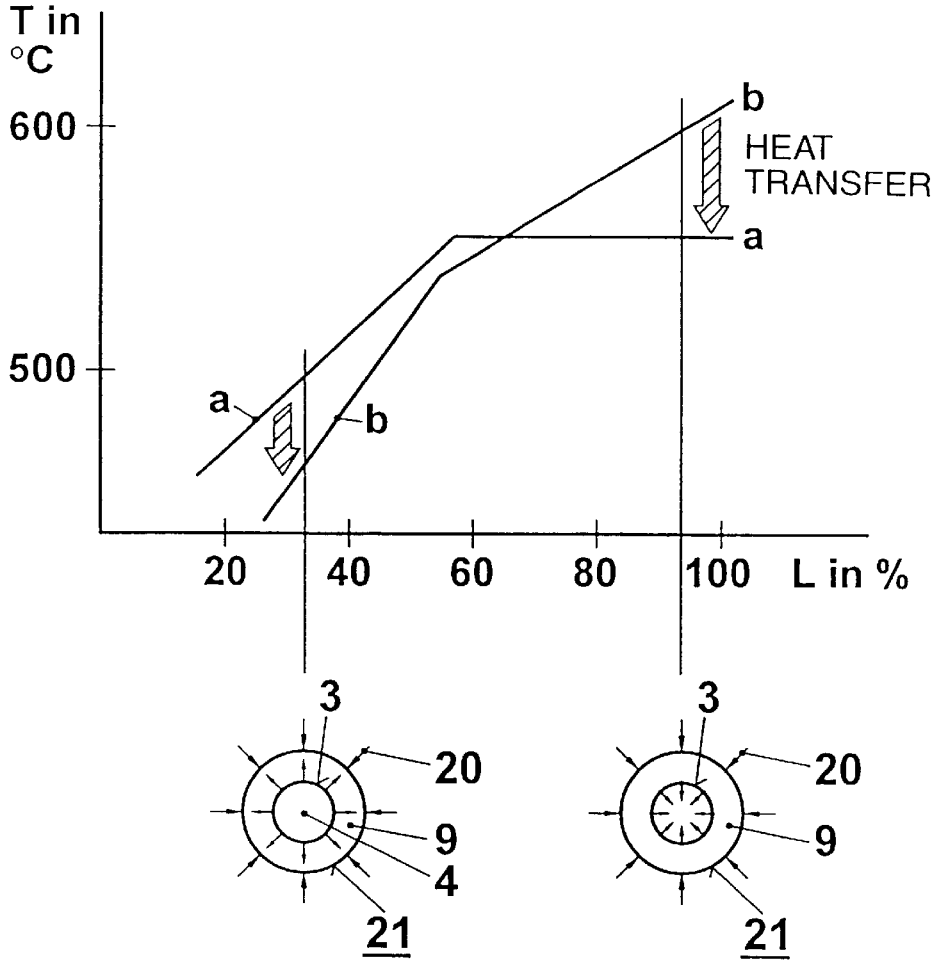
FIG. 5C FIG. 5D
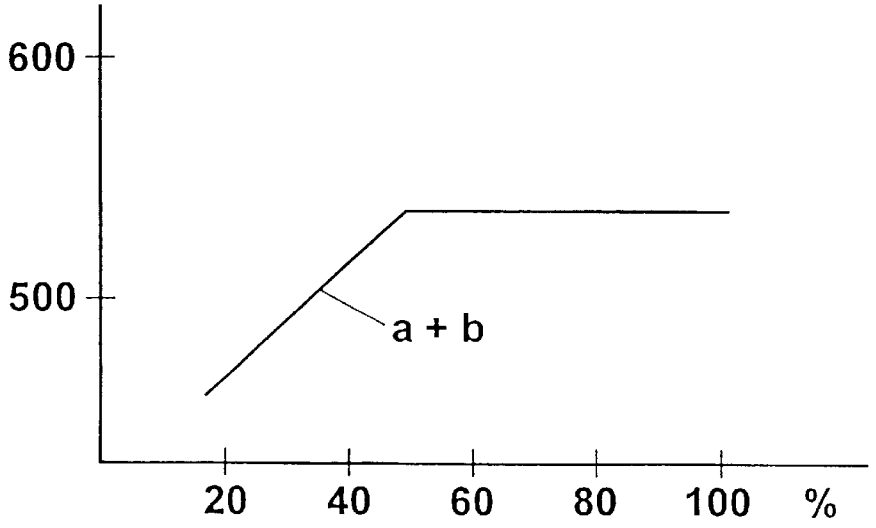
FIG. 5B

FIG. 8A
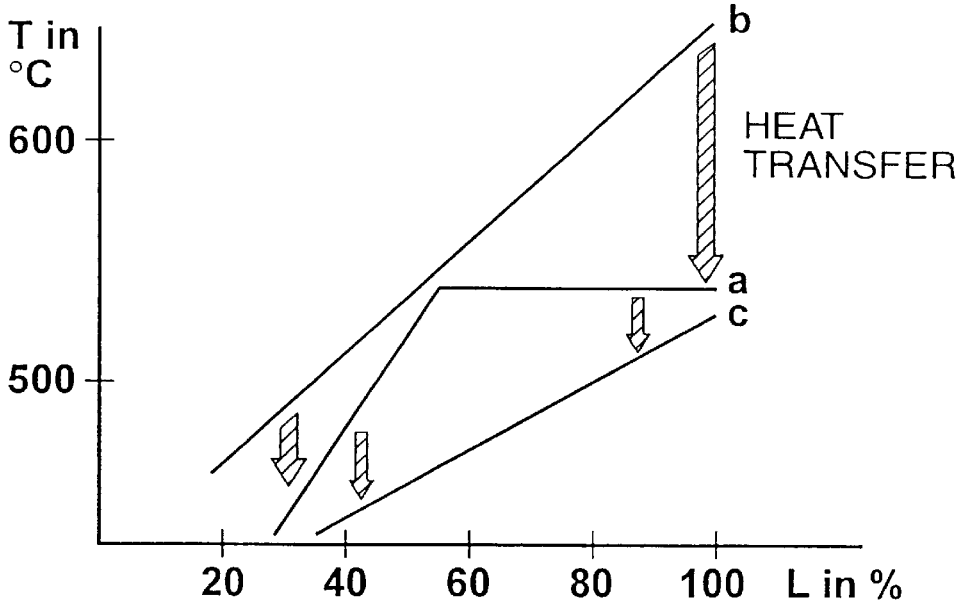
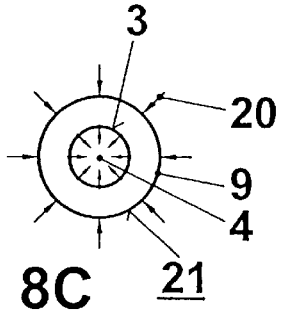
FIG. 8C
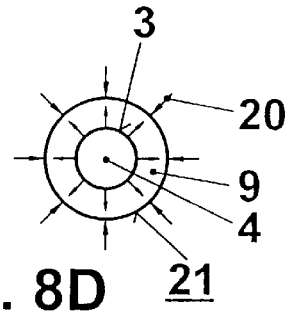
FIG. 8D
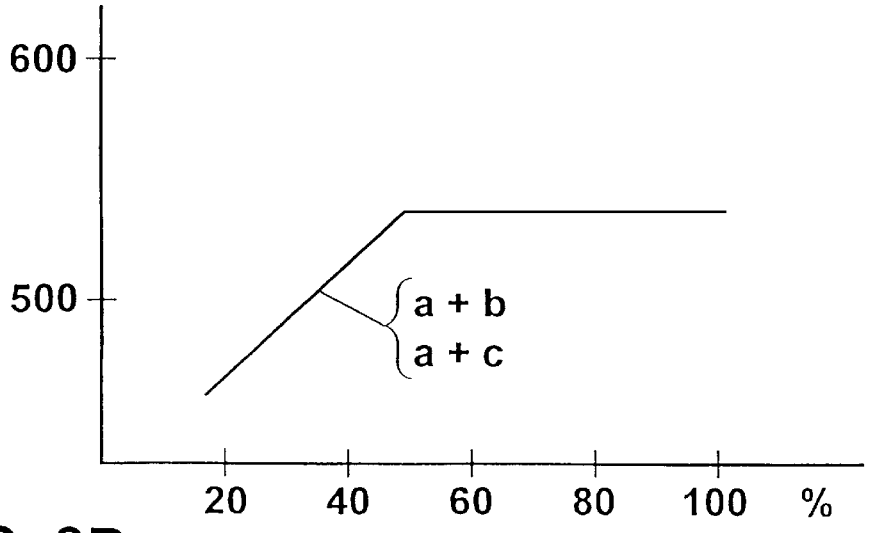
FIG. 8B

METHOD AND DEVICE FOR GENERATING STEAM

BACKGROUND OF THE INVENTION

1. Field of the Invention

The invention relates to a method and a device for generating steam with a conventional steam turbine cycle provided with a steam generator, in which a first relaxation stage in a high-pressure turbine is followed by an intermediate superheating of the steam prior to a second relaxation stage in a medium-pressure turbine, whereby the steam turbine cycle optionally can also be combined with a gas turbine cycle provided with at least one gas turbine, in which gas turbine cycle the gas turbine is followed by a waste heat steam generation plant supplied with water from the steam turbine cycle, and the steam-side output of the waste heat steam generation plant and the steam-side output of the steam generator join upstream from the high-pressure turbine of the steam turbine cycle to flow into a common live steam line.

2. Brief Description of the Related Art

Conventional steam power plants essentially consist of a steam generator, which is powered mostly with coal or oil, but increasingly also with gas, and of several steam segment turbines (high-pressure, medium-pressure, low-pressure steam turbines), as well as a generator for converting the steam energy into electrical energy. To increase the efficiency, it is common practice to perform an intermediate superheating of the steam relaxed in the high-pressure turbine before it is fed to the medium-pressure turbine.

The temperatures of the superheated and intermediately superheated steam vary in this state of the art depending on the boiler load. For a low boiler load, the temperature of the superheated steam is higher than that of the intermediately superheated steam; for a high boiler load, the temperature of the intermediately superheated steam is higher than the temperature of the superheated steam. The intermediate superheater is designed for part of the live steam/HP superheater steam throughput, since in a conventional steam power plant, the steam is bled for the regenerative preheating, and the throughput in the steam turbine is continuously reduced up to the steam turbine discharge/condenser. The throughput of the superheater is therefore much higher for a conventional steam power plant than the mass stream through the intermediate superheater. For this reason a reduction of the intermediate superheater temperature must be achieved in the case of higher boiler loads.

Since the heat exchange surfaces of superheater and intermediate superheaters are fixed in a particular case, the steam temperature must be regulated, i.e. it must be maintained constant within specific limits (maximum temperature depends on material; minimum temperature depends on output to be achieved). This may be accomplished, for example, by changing the fuel system/rotating the burners, by steam cooling based on water injection, by recycling of flue gas or by bypassing heat exchange surfaces (guide baffle regulation).

However, these known solutions for regulating the steam temperature have several disadvantages. On the one hand, they have only a limited effect; on the other hand, they require the installation of additional hardware, thus increasing cost. In the case of steam cooling by water injection between or after the superheater or intermediate superheater sections, the performance will also be reduced. The devices, such as guide baffles which move under extreme conditions (high temperatures, corrosion), also have a disadvantageous effect.

DE 195 42 917 A1 and R. Bachmann, M. Fetescu, and H. Nielsen: More than 60% Efficiency by Combining Advanced Gas Turbines and Conventional Steam Power Plants, Power Gen '95 Americas, Anaheim, Calif., U.S.A., Dec. 5–7, 1995, describe, for example, combined power plants in which a steam cycle, like the one described above, is combined with intermediate superheating with a gas turbine cycle, whereby the gas turbine is followed by a waste heat boiler which generates additional live steam from part of the feed water. This additional live steam from the waste heat boiler has the result that the live steam mass stream discharged from the main boiler must be smaller than the live steam discharge from the boiler of a conventional steam power plant. Since the preheating of the condensate and feed water in the waste heat boiler additionally reduces the bleeding volume of the relaxed steam from the LP steam turbine, the steam throughput through the steam turbine is increased, so that the boiler load must be reduced. As a result, the cold intermediate superheater mass steam of a combined system is much greater than the live steam mass steam of the boiler, thus creating a disproportion between them.

In the known state of the art, the live steam generated in the main boiler and in the waste heat boiler is only intermediately superheated in the main boiler. Although this has a number of advantages, such as, e.g., enabling high flexibility in the operating mode while maintaining very high efficiency, this also has disadvantages. The superheater of the main boiler is operated at a partial load, and the intermediate superheater is operated at the higher base load. If the combined power plant operates without any modification, this has the result that the steam temperature is reduced at the outlet of the intermediate superheater, and the medium-pressure turbine output, and accordingly the efficiency of the power plant, are reduced.

SUMMARY OF THE INVENTION

The present invention attempts to avoid all of the aforementioned disadvantages. The invention relates to methods and apparatus for generating steam of the above mentioned type, in which an increased efficiency is achieved in all operating modes by means of a simple temperature control, and which will require little cost. The device is usable for new power plants, and it is also suitable for retrofitting existing coal-, oil- or gas-powered steam power plants, e.g., conventional steam power plants or combined plants.

According to an exemplary embodiment of the present invention, a method for generating steam with a conventional steam turbine cycle provided with a steam generator, in which the steam from the superheater of the steam generator is fed to a high-pressure turbine, is partially relaxed there in a first relaxation stage, is then intermediately superheated in an intermediate superheater, and is then relaxed in at least one more relaxation stage, whereby the steam turbine cycle optionally can also be combined with a gas turbine cycle provided with at least one gas turbine, in which gas turbine cycle the gas turbine is followed by a waste heat steam generation plant supplied with water from the steam turbine cycle, and the steam from the waste heat steam generating plant and the steam from the steam generator are fed upstream from the high-pressure turbine of the steam turbine cycle into a common live steam line, and in which at least part of the superheated steam undergoes an indirect heat exchange in the superheater, and the intermediately superheated steam undergoes an indirect heat exchange in the intermediate superheater.

According to another exemplary embodiment of the present invention, a device for generating steam with a conventional steam turbine cycle is provided with a steam generator including a superheater, in which a first relaxation stage in a high-pressure turbine is followed by an intermediate superheating of the steam in an intermediate superheater prior to at least one more relaxation stage in a medium-pressure turbine or low-pressure turbine, whereby the steam turbine cycle optionally can also be combined with a gas turbine cycle provided with at least one gas turbine, in which gas turbine cycle the gas turbine is followed by a waste heat steam generation plant supplied with water from the steam turbine cycle, and the steam-side output of the waste heat steam generation plant and the steam-side output of the steam generator join upstream from the high-pressure turbine of the steam turbine cycle into a common live steam line, and wherein the superheater and the intermediate superheater are provided with at least one superheater/intermediate superheater heat exchanger unit.

The advantages of the invention are that a high degree of efficiency is achieved in all operating modes of the plant through the heat exchange between the superheater and intermediate superheater. The costs for an expansion, retrofit or refitting of existing conventional steam power plants are relatively low. The invention makes it possible to convert a conventional steam power plant into a combined power plant without the disadvantages described for the state of the art technology.

In another embodiment, the heat exchange can also take place reversibly, whereby, in the case of the smaller loads of the steam generator, part of the heat energy from the superheater steam is transferred to the intermediate superheater steam, and, conversely, in the case of higher loads of the steam generator, part of the heat energy of the intermediate superheater steam is transferred to the superheater steam. This makes it possible to realize a simple temperature control that will result in an increase in efficiency.

It is also advantageous if the amount of superheated live steam that is in heat transfer with the intermediately superheated steam is regulated in relation to the size of the load of the steam generator, the size of the steam mass stream through the superheater and the intermediate superheater, and the temperature of the intermediate superheater in relation to the respective site of the heat exchange.

Finally, it is advantageous that at least one superheater/intermediate superheater heat exchanger unit is located within the steam generator, whereby hot gas now flows around the heat exchanger unit. The heat exchanger unit then consists of a double-walled pipe, whereby its inner pipe is provided for the superheater steam flow and the outer pipe for the intermediate superheater steam flow, and whereby hot gas flows around the outer pipe.

It is possible, for example, to replace already existing heat exchanger surfaces with the superheater/intermediate superheater heat exchanger unit, so that no additional space is needed. If there is not enough space within the steam generator, then at least one superheater/intermediate superheater heat exchanger unit is placed outside the steam generator. It is also useful that at least one superheater/intermediate superheater heat exchanger unit can be combined with one of the known devices for steam temperature regulation. In this case, both regulation methods would supplement each other.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which:

FIGS. 5*a*–5*d* illustrate a typical dependency of the steam temperature in the superheater and in the intermediate superheater from the steam generator load;

FIGS. 8*a*–8*d* illustrate a dependency of the steam temperature in the superheater, and for two different cases, in the intermediate superheater from the steam generator load.

DESCRIPTION OF THE PREFERRED EMBODIMENTS

Figure 1:
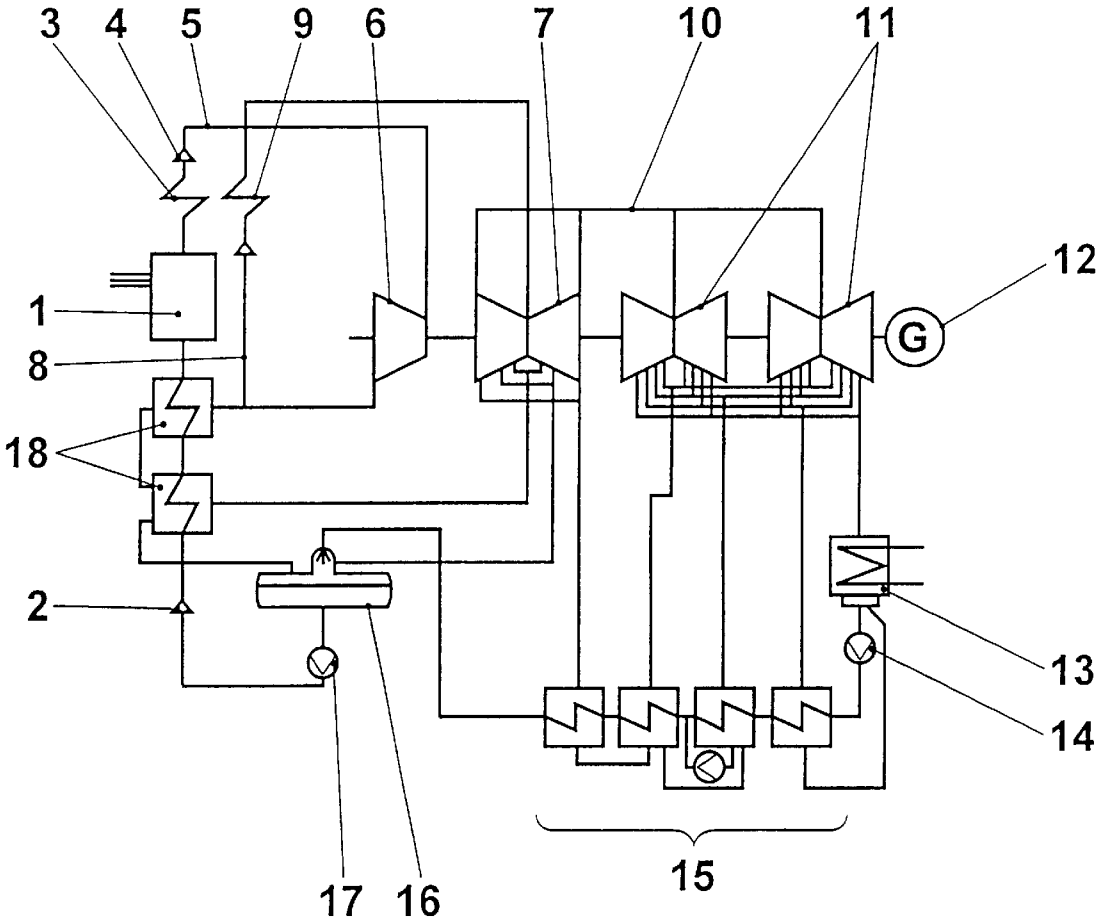
FIG. 1 (PRIOR ART)
FIG. 1 illustrates a schematic block diagram of a conventional steam power plant.

Referring to the drawing figures, like reference numerals designate identical or corresponding elements throughout the several figures. Throughout the drawing figures and the following detailed description, only those elements essential for understanding the invention are shown. The flow direction(s) of the media is (are) illustrated with arrows.

FIG. 1 illustrates a schematic of a conventional steam power plant with an intermediate superheater according to the known state of the art. In a steam generator 1 fueled preferably with oil or coal, which can also be fueled with gaseous fuel, the hot gases of the steam generator 1 evaporate feed water 2 which is then superheated in a superheater 3, resulting in live steam 4. The live steam 4 passes through a live steam line 5 into a high-pressure steam turbine 6 and is partially relaxed there. After the partial relaxation in the high-pressure part 6 of the steam turbine, the steam is passed prior to its entrance into the medium-pressure turbine 7 via a line 8 to an intermediate superheater 9 and undergoes intermediate superheating there. The steam which is then partially relaxed in the medium-pressure turbine 7 is then fed via lines 10 to the two low-pressure turbines 11. The high-pressure, medium-pressure, and low-pressure turbines 6, 7, 11 are arranged with a generator 12 on a common shaft. The relaxed working steam condenses in the condenser 13. In the form of a condensate, the working medium is now fed by a condensate pump 14 via bleed steam-heated low-pressure preheaters 15 into the feed water vessel/degasser 16, from where it is fed by a feed water pump 17 into a bleed steam-heated feed water high-pressure preheater 18, and from there to the steam generator 1.

Figure 2:
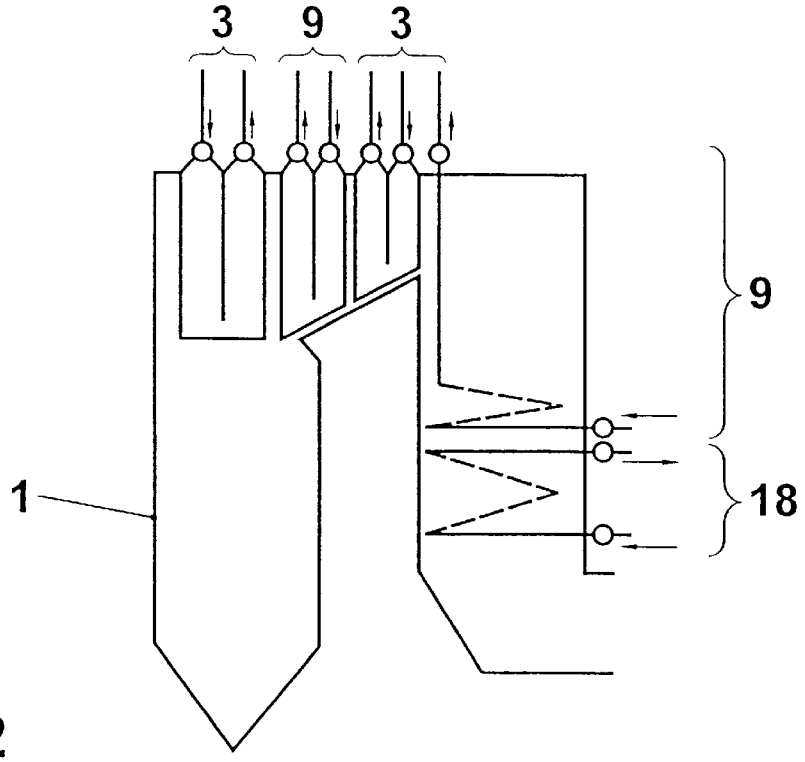
FIG. 2 (PRIOR ART)
FIG. 2 illustrates a typical arrangement of the heat exchanger surfaces in a conventional steam generator according to the known state of the art.

FIG. 2 shows a typical arrangement of the heat exchanger surfaces of superheater 3, intermediate superheater 9, and feed water high-pressure preheater 18 in a steam generator 1 according to the state of the art. The fixed superheater/intermediate superheater heat exchange surfaces result in disadvantages, already explained for the state of the art, when the power plant is operated.

According to the present invention, a simple temperature regulation of the steam can be performed if at least part of the superheated steam in the superheater 3 and the intermediately superheated steam are subjected to an indirect heat exchange in the intermediate superheater 9. The amount of superheated live steam which is in heat exchange with the intermediately superheated steam is regulated in relation to the size of the load of the steam generator 1, the size of the steam mass stream through the superheater and the intermediate superheater, and the temperature of the intermediate superheater dependent on the respective site of the heat exchange.

Figure 3:
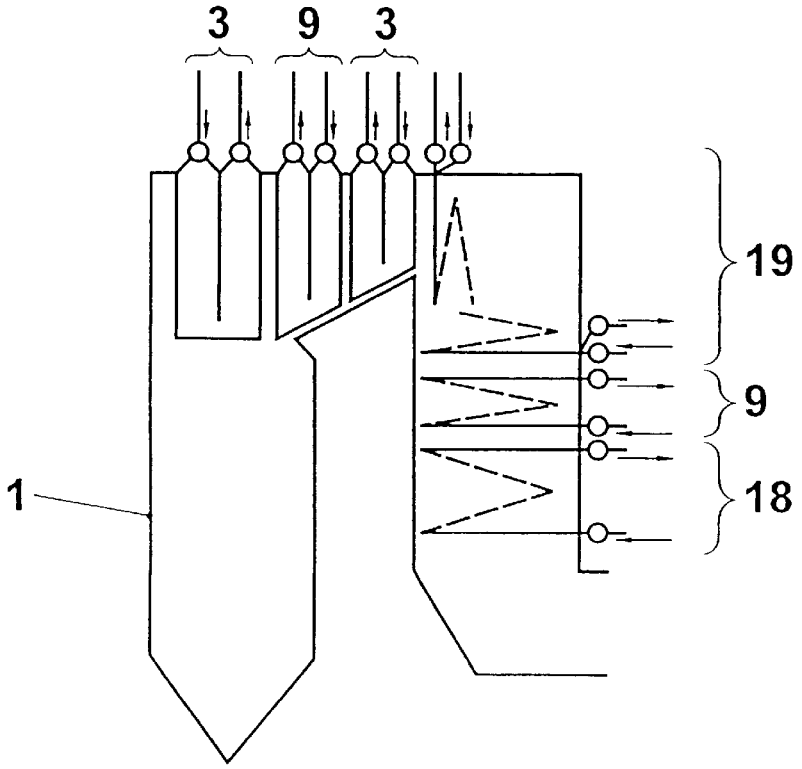
FIG. 3 illustrates a first embodiment of a steam generator in which the superheater/intermediate superheater heat exchanger unit, according to the present invention, is located within the steam generator.

FIG. 3 illustrates a first embodiment of a steam generator 1 in which the superheater 3 and the intermediate superheater 9 are provided with at least one superheater/intermediate superheater heat exchanger unit 19 according to the invention, whereby the heat exchanger unit 19 consists of a double pipe 21 around which hot gas 20 flows, and the inner pipe is provided for the superheater steam and the outer pipe for the intermediate superheater steam. Such heat exchangers are known as triflux heat exchangers. In the embodiment shown in FIG. 3, the heat exchanger unit 19 is arranged within the steam generator 1. Several of these heat exchanger units 19 can be arranged horizontally and/or vertically in the boiler. It is also possible to arrange the heat exchanger unit 19 to the already existing heat exchange surfaces in the steam generator 1, or to replace already existing heat exchange surfaces of the superheater 3 and/or intermediate superheater 9 with the heat exchanger units 19 of the invention. Depending on the intermediate superheater and superheater temperature profile, the heat exchanger unit 19 can also be placed in other locations than those shown in FIG. 3.

Figure 4:
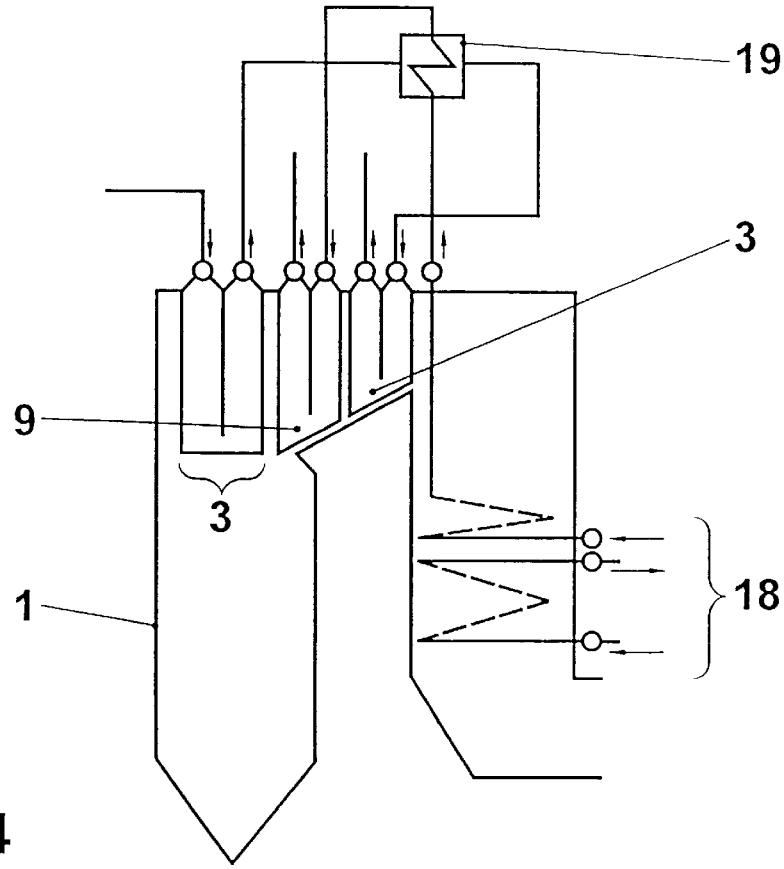
FIG. 4 illustrates a second embodiment of a steam generator in which the superheater/intermediate superheater heat exchanger unit, according to the present invention, is located outside the steam generator.

A second embodiment is illustrated in FIG. 4. Here the heat exchanger unit 19 is placed outside the steam generator 1. Such a solution is advantageous if no space for retrofitting with the unit 19 is available inside an already existing steam generator 1. Naturally, the heat exchanger unit 19 can also be arranged in another place than that illustrated in FIG. 4, depending on the respective temperature profile.

FIG. 5*a* illustrates the typical relationship of the steam temperature T in the superheater (curve a) and in the intermediate superheater 9 (curve b) to the load L of the steam generator 1 in a conventional steam power plant. The two curves a and b clarify the conditions without steam temperature regulation, and without the solution provided by the invention; i.e. for lower loads L, the steam in the superheater 3 has significantly higher temperatures than the steam in the intermediate superheater 9 (intermediate superheater temperature is too low), while for high loads L, the steam in the superheater 3 has lower temperatures T than the steam in the intermediate superheater 9 (intermediate superheater temperature is too high).

If a combined superheater/intermediate superheater heat exchanger unit 19 is arranged inside the steam generator 1, which unit 19 includes a double-walled pipe 21, whereby its inner pipe is provided for the superheater steam flow and the outer pipe for the intermediate superheater steam flow, as schematically shown in FIGS. 5*c* and 5*d* and whereby hot gas 20 flows around the outer pipe, a transfer of heat energy from the superheater 3 into the intermediate superheater 9 takes place at lower loads L of the steam generator 1, while for higher loads L of the steam generator 1 a transport of heat energy from the intermediate superheater 9 to the superheater 3 takes place (represented by the thick arrows), and the steam temperature is in this manner simply regulated and the degree of efficiency is improved.

The heat transfer is schematically illustrated with arrows in the two middle sections of FIG. 5*a*. In the left section (small loads L), a heat transfer takes place both from the outer heating gas 20 (when the heat exchanger unit 19 is arranged inside the steam generator) and from the steam in the superheater 3 to the steam in the intermediate superheater 9, so that its temperature is increased. If the heat exchange unit 19 is arranged outside the steam generator 1 (not shown), then no heat transfer would take place from the hot gas 20 to the steam in the intermediate superheater 9, since no hot gas 20 is present there. In this case the heat exchanger unit 19 is only a biflux heat exchanger, in which a heat transfer from the steam in the superheater 3 to the steam in the intermediate superheater 9 takes place in the presence of small loads.

In the right, middle section of FIG. 5*a* (high loads L), a reversed heat transfer takes place in the superheater/intermediate superheater heat exchanger unit 19, since heat energy from the steam in the intermediate superheater 9 is transferred to the steam of the superheater 3, so that the steam temperature of the intermediate superheater 9 is reduced. As a result, the two curves a and b are, in accordance with the arrow direction in FIG. 5*a*, adapted, so that a temperature profile as shown in FIG. 5*b* is created, and thus the steam temperature is regulated. The term "reversible heat exchange" stands for the above mentioned transfer of heat energy from the intermediate superheater to the superheater on one hand, and from the superheater to the intermediate superheater on the other hand.

Figure 7:
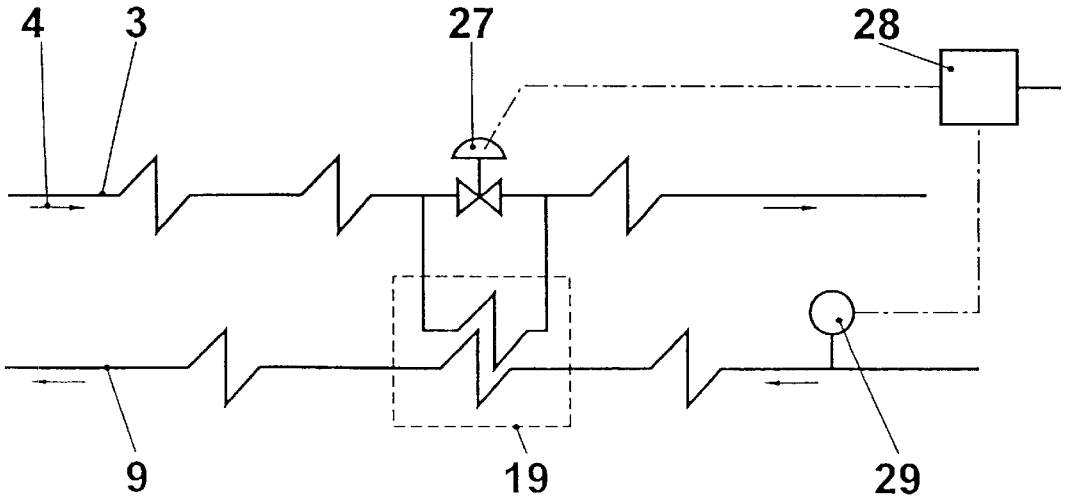
FIG. 7 illustrates a detail of FIG. 6 in the superheater/intermediate superheater section.
Figure 6:
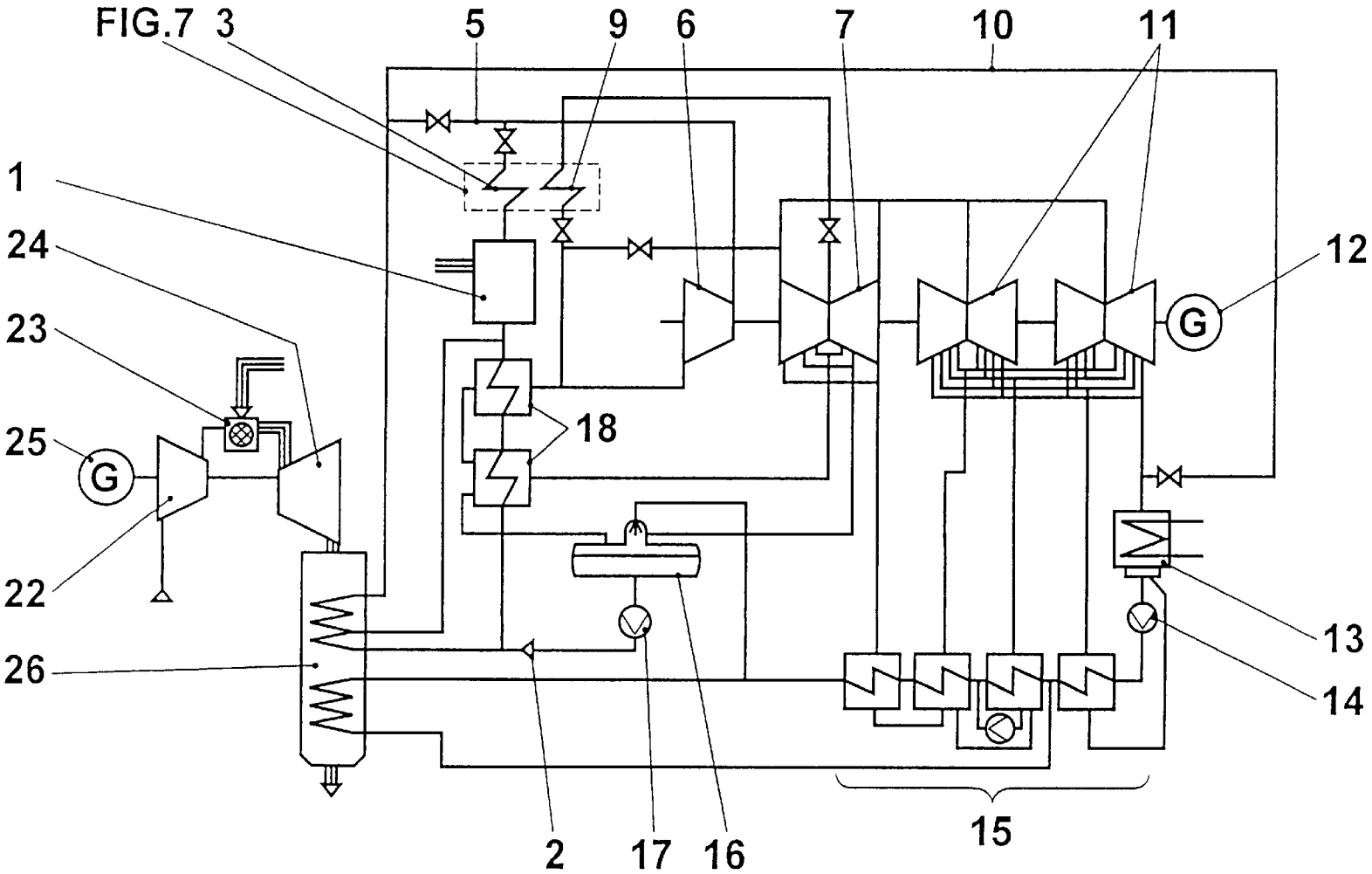
FIG. 6 illustrates a schematic block diagram of a combined power plant.

FIGS. 6 to 8 illustrate an embodiment of the invention using a combined power plant (hybrid mode). FIG. 6 illustrates a schematic of a combined power plant for electricity generation, which is provided with a conventional steam cycle (see FIG. 1) and an additional gas turbine cycle. In the gas turbine cycle, the drawn-in fresh air is compressed in a compressor 22 to the working pressure. The compressed air is heated in a furnace chamber 23, fueled, for example, with natural gas, and the resulting fuel gas is relaxed in a gas turbine 24 in a work-performing manner. The energy obtained with this is fed to a generator 25 or a compressor 22. The still hot waste gas of the gas turbine is fed to a waste heat steam generating plant 26 and is released into the atmosphere through a chimney after it has transferred its heat.

The steam cycle in FIG. 6 differs from that illustrated in and described with reference to FIG. 1, in that the feed water 2 collected in the feed water vessel 16 and brought to installation pressure in the feed water pump 17 is divided into two partial streams. The first stream passes through the preheater 18 into the steam generator 1. The second partial stream is fed to the waste heat steam generating plant 26. There, the feed water 2 is evaporated and superheated in heat exchange with the hot waste gas of the gas turbine 24. The steam should have the same state at the steam-side outlet as the live steam at the outlet of the steam generator 1. The two superheated partial steam streams flow upstream from the steam turbine into the common live steam line 5, which supplies the high-pressure turbine 6.

After partial relaxation in the high-pressure turbine 6, the steam is intermediately superheated prior to entering the medium-pressure turbine 7. In the example, this intermediate superheating takes place in at least one superheater/intermediate superheater heat exchanger unit 19, as is shown in detail in FIG. 7.

FIG. 7, in an enlarged detail of FIG. 6, illustrates the arrangement of the superheater/intermediate superheater heat exchanger unit 19 according to the present invention. Part of the live steam 4 flowing through the superheater 3, or the entire live steam volume, is fed into the unit 19, whereby the amount of the live steam is adjusted to the respective conditions by means of a control valve 27 which is connected to a regulator 28. On the other side, intermediate superheater steam, as a second medium, is introduced into the heat exchanger unit 19, whereby its amount is regulated by a mass stream nozzle 29. Then an already described heat transfer occurs between the steam streams flowing in their respective pipes.

In a combined power plant, the main boiler is operated at a partial load in order to keep the live steam mass stream within the necessary limits. According to this operating mode, the superheater live steam is also generated at a partial load, whereby the intermediate superheater steam mass stream is however much higher due to the additional steam provided by the waste heat steam generator of the gas turbine. This disproportion between the superheater and intermediate superheater has the result that the higher intermediate superheater mass stream results in a lower temperature in the intermediate superheater. This requires additional fuel for the intermediate superheater section. The steam mass stream in the superheater is constant, and the temperature is regulated by a heat transfer from the steam of the superheater to the steam of the intermediate superheater (see, also, FIG. 8, top section, curve c).

FIG. 8*a* illustrate the steam temperature T in the superheater 3 (curve a) and in the intermediate superheater 9 for two different cases (curves b and c) in relation to the load L of the steam generator 1. These three curves a, b, and c clarify the conditions without steam temperature regulation and without the solution according to the invention; i.e., in the first case (curve b), the steam in the (enlarged) intermediate superheater 9 has significantly higher temperatures over the entire load range than the steam in the superheater 3, while in the second case (curve c) the steam in the intermediate superheater 9 has lower temperatures over the entire load range than the steam in the superheater 9. The latter is, for example, the case in a combined power plant (hybrid mode).

If now at least one combined superheater/intermediate superheater heat exchanger unit 19 is arranged inside or outside the steam generator 1, which in the case of arrangement inside the steam generator 1 consists of a double-walled pipe 21, whereby its inner pipe is provided for the superheater steam flow and the outer pipe for the intermediate superheater steam flow, and whereby hot gas 20 flows around the outer pipe, as schematically shown in FIGS. 8*c* and 8*d*, then the heat energy is transferred from the intermediate superheater 9 to the superheater 3 (curve b), while in the second case the heat energy is transferred from the superheater 3 to the intermediate superheater 9 (represented by the thick arrows).

The heat transfer is schematically illustrated with arrows in the two middle sections of FIG. 8*a*. In the left section, a heat transfer takes place from the outer heating gas 20 (when the heat exchanger unit 19 is arranged inside the steam generator 1) to the steam in the intermediate superheater 9 and then to the steam in the superheater 3, so that its temperature is increased. In the right section of the drawing, in contrast, a heat transfer takes place in the superheater/intermediate superheater heat exchanger unit 19 in such a way that the heat energy is transferred from the steam of the superheater 3 to the steam of the intermediate superheater 9, so that the steam temperature of the superheater 3 is reduced. As a result, the two curves, a and b or a and c, are adapted according to the direction of the arrow in FIG. 8*b*, so that a temperature profile as shown in the bottom section of FIG. 8 is created, and the temperature of the steam is regulated in a simple manner and the degree of efficiency is improved.

It is critical that the heat energy from the two separate systems in the combined power plant (superheater and intermediate superheater) is combined in such a manner that finally a uniform temperature is achieved both for the steam in the intermediate superheater 9 and for the steam in the superheater 3.

If the temperature regulation effects achieved with the invention should not be sufficient, the superheater/intermediate superheater heat exchanger unit 19 according to the present invention can also be combined with the steam temperature regulation methods known from the state of the art and already mentioned above.

While the invention has been described in detail with reference to preferred embodiments thereof, it will be apparent to one skilled in the art that various changes can be made, and equivalents employed, without departing from the scope of the invention.

What is claimed is:

1. A method for generating steam with a conventional steam turbine cycle provided with a steam generator, in which the steam from a superheater of the steam generator is fed to a high-pressure turbine, is partially relaxed there in a first relaxation stage, is then intermediately superheated in an intermediate superheater, and is then relaxed in at least one more relaxation stage, whereby the steam turbine cycle can also be combined with a gas turbine cycle provided with at least one gas turbine, in which gas turbine cycle the gas turbine is followed by a waste heat steam generation plant supplied with water from the steam turbine cycle, and the steam from the waste heat steam generating plant and the steam from the steam generator are fed upstream from the high-pressure turbine of the steam turbine cycle into a common live steam line, wherein at least part of the superheated steam in the superheater and the intermediately superheated steam in the intermediate superheater undergo an indirect heat exchange in relation to the size of the load of the steam generator.

2. A method according to claim 1, wherein the heat exchange is reversible, whereby in the case of small loads of the steam generator, part of the heat energy of the steam of the superheater is transferred to the steam of the intermediate superheater, and, conversely, in the case of higher loads of the steam generator, part of the heat energy of the steam of the intermediate superheater is transferred to the steam of the superheater.

3. A method according to claim 1, wherein part of the heat energy of the steam of the superheater is transferred to the steam of the intermediate superheater over the entire load range.

4. A method according to claim 1, wherein part of the heat energy of the steam of the intermediate superheater is transferred to the steam of the superheater over the entire load range.

5. A method according to claim 1, wherein the amount of the superheated live steam which is in heat exchange with the intermediately superheated steam is regulated in relation to the size of the load of the steam generator, the size of the steam mass stream through the superheater and the intermediate superheater, and in relation to the respective site of the heat exchange.

6. A device for generating steam in a conventional steam turbine cycle comprising a steam generator with superheater, in which a first relaxation stage in a high-pressure turbine is followed by an intermediate superheating of the steam in an intermediate superheater prior to at least one more relaxation stage in a medium-pressure turbine or low-pressure turbine, wherein the steam turbine cycle can also be combined with a gas turbine cycle provided with at least one gas turbine, in which gas turbine cycle the gas turbine is followed by a waste heat steam generation plant supplied with water from the steam turbine cycle, and the steam-side output of the waste heat steam generation plant and the steam-side output of the steam generator join upstream from the high-pressure turbine of the steam turbine cycle into a common live steam line, and wherein the superheater and the intermediate superheater are provided with at least one superheater/intermediate superheater heat exchanger unit.

7. A device according to claim 6, wherein the at least one superheater/intermediate superheater heat exchanger unit is arranged inside the steam generator, wherein the heat exchanger unit comprises a double-walled pipe including an inner pipe and an outer pipe, wherein the inner pipe is provided for the superheater steam flow and the outer pipe for the intermediate superheater steam flow, and whereby hot gas flows around the outer pipe.

8. A device according to claim 6, wherein the superheater/intermediate superheater heat exchanger unit is arranged outside the steam generator.

* * * * *